US012096812B2

(12) United States Patent
Hiney

(10) Patent No.: US 12,096,812 B2
(45) **Date of Patent: *Sep. 24, 2024**

(54) WAISTBAND CONSTRUCTION

(71) Applicant: The Gap, Inc., Albuquerque, NM (US)

(72) Inventor: Joshua David Hiney, San Francisco, CA (US)

(73) Assignee: The Gap, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/083,374

(22) Filed: Dec. 16, 2022

(65) Prior Publication Data

US 2023/0124450 A1 Apr. 20, 2023

Related U.S. Application Data

(63) Continuation of application No. 17/027,465, filed on Sep. 21, 2020, now Pat. No. 11,632,993, which is a continuation of application No. 16/428,873, filed on May 31, 2019, now Pat. No. 10,779,594.

(60) Provisional application No. 62/683,687, filed on Jun. 12, 2018.

(51) Int. Cl.
*A41F 9/02* (2006.01)

(52) U.S. Cl.
CPC ..... *A41F 9/02* (2013.01)

(58) Field of Classification Search
CPC ... A41F 9/02; A41F 9/025; A41F 9/00; A41D 20/00
See application file for complete search history.

(56) References Cited

U.S. PATENT DOCUMENTS 717,868 A 1/1903 Kleiderer
1,652,567 A * 12/1927 Foster ..... A41F 9/00 2/236

(Continued)

FOREIGN PATENT DOCUMENTS

CN 203182089 U 9/2013
DE 29613086 U1 9/1996

(Continued)

OTHER PUBLICATIONS

International Searching Authority, International Search Report and Written Opinion for application PCT/US19/35069, mailed on Sep. 23, 2019, 10 pgs.

*Primary Examiner* — Bao-Thieu L Nguyen
(74) *Attorney, Agent, or Firm* — Morgan, Lewis & Bockius LLP

(57) ABSTRACT

An article of clothing, the article of clothing including a fabric. The fabric defines a waistband portion having an interior. The fabric also defines a base fabric panel. Additionally, the article of clothing includes an elastic layer. The interior of the waistband faces the elastic layer. Moreover, the interior of the waistband is defined by one or more folds forming a border between the base fabric panel and the waistband. The one or more folds include an initial bottom fold and a final bottom fold of the fabric. The one or more folds further include a top fold at a top edge of the waistband. The waistband is attached to the elastic layer through the initial bottom fold and the top fold. Additionally, an interior of the final bottom fold and the interior of the top fold are common to the interior of the waistband.

19 Claims, 6 Drawing Sheets

(56) References Cited

U.S. PATENT DOCUMENTS 1,672,017 A * 6/1928 Wright ..... A41F 9/02 2/237
1,944,507 A * 1/1934 Grasso ..... A41F 9/00 2/236
2,324,371 A * 7/1943 Deichert ..... A41D 1/21 2/76
2,418,772 A 4/1947 Jackson
2,438,804 A * 3/1948 Hardie ..... A41F 9/02 2/221
2,443,951 A 6/1948 Fenton
2,569,853 A * 10/1951 Grue ..... A41F 9/02 2/237
2,718,011 A * 9/1955 Caruso ..... A41F 9/00 2/236
2,898,601 A * 8/1959 Presson ..... A41D 1/14 2/211
2,986,742 A * 6/1961 Kuber ..... A41F 9/00 2/220
3,111,681 A * 11/1963 Nelson ..... A41D 27/24 2/232
3,663,963 A * 5/1972 Miller ..... D03D 15/00 2/237
3,761,966 A * 10/1973 Augustin ..... A41F 9/00 2/236
3,869,728 A 3/1975 Spencer
4,168,546 A * 9/1979 O'Connor ..... A41F 9/00 2/220
4,503,567 A * 3/1985 Muse ..... A41F 9/02 2/76
4,549,317 A * 10/1985 D'Ambrosio ..... A41F 9/02 2/237
4,662,008 A * 5/1987 Weiser ..... A41D 1/14 2/211
4,697,288 A * 10/1987 Palumbo ..... A41D 15/002 2/919
4,720,874 A * 1/1988 Crawford ..... A41F 9/02 2/244
4,970,728 A * 11/1990 D'Ambrosio ..... A41F 9/02 2/221
5,010,595 A * 4/1991 Stradley ..... A41D 1/06 2/234
5,127,108 A * 7/1992 Weiss ..... A41D 1/06 2/221
5,168,581 A * 12/1992 Garcia ..... A41F 9/02 2/221
5,230,761 A 7/1993 Crawford
5,483,702 A * 1/1996 D'Ambrosio ..... A41F 9/02 2/221
5,675,842 A * 10/1997 Schaefer ..... A41D 1/062 2/400
7,569,041 B2 8/2009 Stupperich et al.
8,336,474 B2 12/2012 Zhang et al.
10,779,594 B2 * 9/2020 Hiney ..... A41F 9/02
11,632,993 B2 * 4/2023 Hiney ..... A41F 9/02 2/237
2004/0040070 A1 * 3/2004 Wong ..... A41F 9/02 2/338
2008/0078012 A1 * 4/2008 Mario ..... A41F 9/02 2/237
2009/0038046 A1 * 2/2009 Moore ..... A41D 1/08 2/67
2012/0178344 A1 * 7/2012 D'Anza ..... A41D 1/21 450/95
2014/0373254 A1 * 12/2014 Ogawa ..... A41D 31/00 428/353
2015/0126956 A1 5/2015 Raycheck et al.
2017/0314176 A1 11/2017 Demarest et al.
2018/0035736 A1 * 2/2018 Le ..... A41D 27/20

FOREIGN PATENT DOCUMENTS

GB 918096 A 2/1963
GB 1404260 A 8/1975
GB 1411401 A 10/1975
GB 2194428 B 3/1988
KR 10-1282405 B1 10/1973
KR 10-832080 B1 5/2008

* cited by examiner

WAISTBAND CONSTRUCTION

CROSS REFERENCE TO RELATED APPLICATION

The present application is a continuation of U.S. patent application Ser. No. 17/027,465, filed Sep. 21, 2020, entitled "Waistband Construction," which is a continuation of U.S. patent application Ser. No. 16/428,873, filed May 31, 2019, entitled "Waistband Construction," now U.S. Pat. No. 10,779,594, which claims priority to U.S. Provisional Patent Application No. 62/683,687, filed Jun. 12, 2018, entitled "Waistband Construction," each of which is hereby incorporated by reference in its entirety for all purposes.

TECHNICAL FIELD

The present invention, according to some embodiments, relates to waistband constructions for use in articles of clothing.

BACKGROUND

A conventional waistband has a fixed length and is used to hold an article of clothing to a wearer or affix a belt. Some waistbands are elastic, which allows the article of clothing to be worn if a weight of the wearer change. However, when conventional elastic waistbands are stretched or shrunk, the waistbands do not lay flat on the wearer. This stretching and shrinking causes the waistband to either show ribbing of the elastic material or causes the waistband to bunch.

The information disclosed in this Background section is only for enhancement of understanding of the general background of the invention and should not be taken as an acknowledgment or any form of suggestion that this information forms the prior art already known to a person skilled in the art.

SUMMARY

Given the above background, what is needed in the art are waistbands for casual and formal use that will lay flat.

An aspect of the present disclosure is directed to providing an article of clothing. The article of clothing includes a fabric. The fabric defines a waistband portion having an interior. The fabric also defines a base fabric panel. Additionally, the article of clothing includes an elastic layer. The interior of the waistband faces the elastic layer. Moreover, the interior of the waistband is defined by one or more folds forming a border between the base fabric panel and the waistband. The one or more folds include an initial bottom fold and a final bottom fold of the fabric. The one or more folds further include a top fold at a top edge of the waistband. The waistband is attached to the elastic layer through the initial bottom fold and the top fold. Additionally, an interior of the final bottom fold and the interior of the top fold are common to the interior of the waistband.

In some embodiments, the elastic layer is secured to the top fold.

In some embodiments, the elastic layer is secured to the initial bottom fold by a line of stitching. Furthermore, a bottom edge of the elastic layer extends beyond the line of stitching.

In some embodiments, a space is defined between the bottom edge of the elastic layer and the base fabric panel.

In some embodiments, the space is configured to receive a top edge portion of a pocket bag.

In some embodiments, the article of clothing further includes one or more darts. Each of the one or more darts extend through the waistband portion and at least a portion of the base fabric panel.

In some embodiments, each of the one or more darts includes an upper segment through the waistband portion and a lower segment positioned in the base fabric panel. Moreover, the upper segment and the lower segments are substantially aligned.

In some embodiments, the article of clothing further includes at least one belt loop. The at least one belt loop is positioned over one of the one or more darts.

In some embodiments, the fabric includes natural fibers.

In some embodiments, the elastic layer includes a stretch tape.

In some embodiments, the article of clothing further includes an interlining layer interposing between the interior of the waistband portion and the elastic layer.

In some embodiments, the interlining layer includes a stretch fusion layer affixed to the interior of the waistband portion.

In some embodiments, the interlining layer occupies the interior of the waistband between the waistband and the elastic layer.

In some embodiments, the initial bottom fold and the final bottom fold form a pleat.

In some embodiments, the initial bottom fold and the final bottom fold extend for an entire length of the article of clothing.

In some embodiments, the article of clothing further includes a placket extending through a portion of the waistband portion.

In some embodiments, the article of clothing is selected from the group consisting of trousers, pants, shorts, skirts, and shorts.

Yet another aspect of the present disclosure is directed to providing a waistband for an article of clothing. In some embodiments, the waistband includes an exterior waistband portion formed from a fabric layer that is continuous with a base fabric panel of the article of clothing, and a pleat defining a bottom edge of the waistband, the pleat being formed from one or more folds in the fabric layer between the exterior waistband portion and the base fabric panel. In some embodiments, an elastic layer is positioned on an interior side of the exterior waistband portion and attached to the exterior waistband portion. In further embodiments, an interlining layer is disposed at least partially between the exterior waistband portion and the elastic layer.

In some embodiments, the one or more folds includes a first fold and a second fold, the first fold being positioned between the elastic layer and the interlining layer, and the second fold forming the bottom edge of the waistband. In some embodiments, the elastic layer is secured to the bottom edge of the waistband by a line of stitching, and a bottom portion of the elastic layer extends beyond the line of stitching. In some embodiments, a top section of the exterior waistband portion is folded over the interlining layer, forming a third fold that defines a top edge of the waistband.

In some embodiments, the waistband further includes one or more darts, each of the one or more darts extending through the exterior waistband portion and at least a portion of the base fabric panel. In some embodiments, each of the one or more darts includes an upper segment through the exterior waistband portion and a lower segment positioned in the base fabric panel. In some such embodiments, the upper segment and the lower segments are substantially aligned, for example, to provide the appearance of a continuous or straight dart seam.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention can be embodied in different forms and thus should not be construed as being limited to the embodiments set forth herein.

Figure 1:
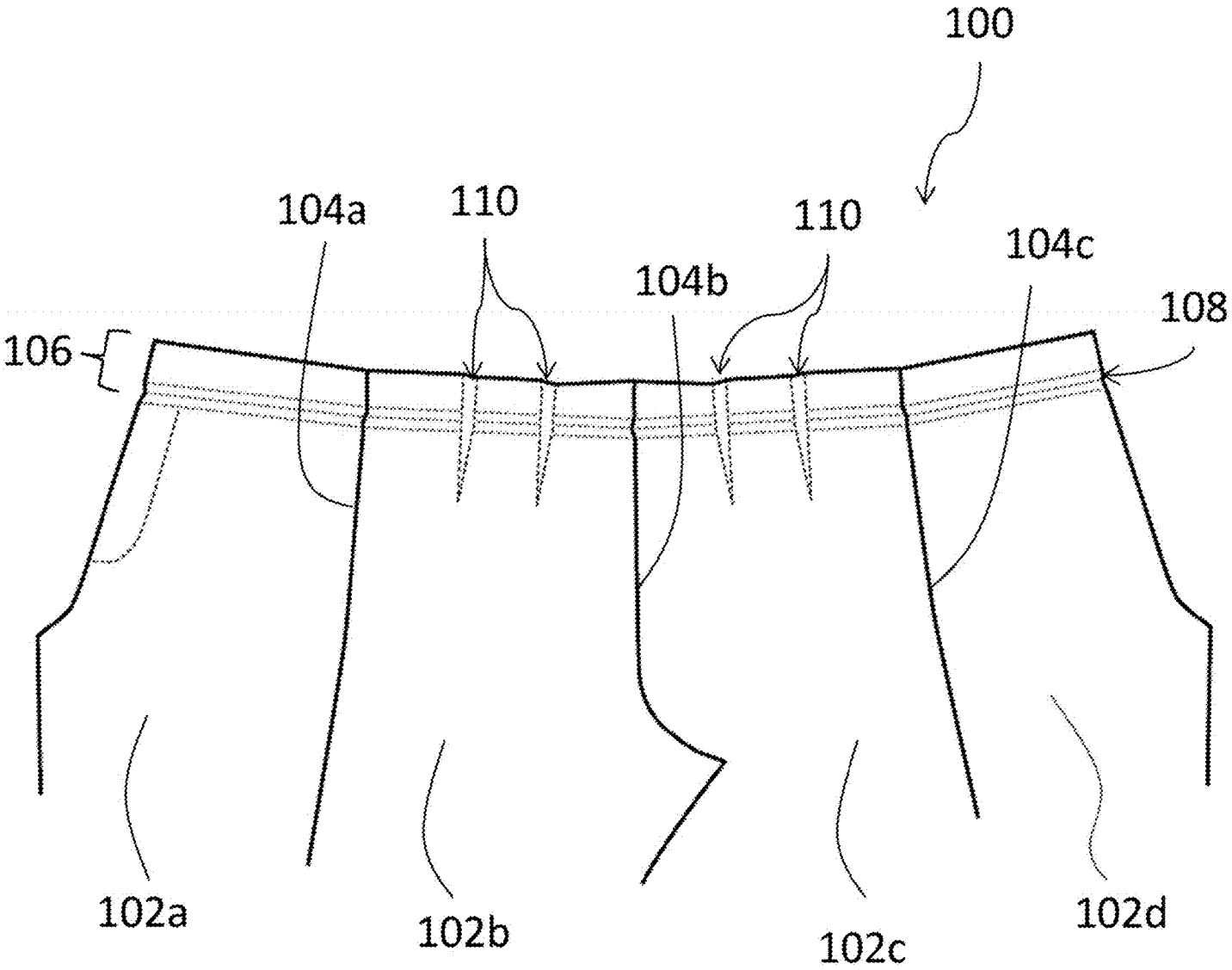
FIG. 1 shows a fabric pattern for forming an article of clothing with a waistband in accordance with an embodiment of the present invention.

In the figures, reference numbers refer to the same or equivalent parts of the present invention throughout the several figures of the drawing.

DETAILED DESCRIPTION

The present subject matter will now be described more fully hereinafter with reference to the accompanying Figures, in which representative embodiments are shown. The present subject matter can, however, be embodied in different forms and should not be construed as limited to the embodiments set forth herein. Rather, these embodiments are provided to describe and enable one of skill in the art. All publications, patent applications, patents, and other references mentioned herein are incorporated by reference in their entirety.

It will also be understood that, although the terms first, second, etc. may be used herein to describe various elements, these elements should not be limited by these terms. These terms are only used to distinguish one element from another. For example, a first stitching could be termed a second stitching, and, similarly, a second stitching could be termed a first stitching, without departing from the scope of the present disclosure. The first stitching and the second stitching are both stitching's, but they are not the same stitching.

The terminology used in the present disclosure is for the purpose of describing particular embodiments only and is not intended to be limiting of the invention. As used in the description of the invention and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In some embodiments, the present invention provides a waistband construction for use in articles of clothing. The articles of clothing may be configured to be worn from the waist or hips of a person and cover at least a portion of the person's lower body, for example, trousers, pants, tights, leggings, shorts, skirts, shorts, breeches, underpants, and the like. In some embodiments, waistbands according to the present invention may include a significant degree of elasticity (stretch) to improve the fit of the article of clothing and/or improve the comfort of the wearer. Moreover, in certain embodiments, a waistband of the present invention may be integrally formed, at least partially, from the base fabric of the article of clothing rather than as a separate component. In some embodiments of the present invention, providing a waistband that is grown on rather than sewn on can increase and/or maximize the amount of stretch in the waistband.

In some embodiments, a waistband construction according to the present invention includes a plurality of layers. In some embodiments, a waistband construction includes an outer fabric layer which forms an exterior portion of the waistband, and an elastic layer which forms an interior portion of the waistband. In some embodiments, a further interlining layer may be included between at least a portion of the first fabric layer and the elastic layer, for example, to provide additional structure or thickness to the waistband. In some embodiments, the outer fabric layer is integral or continuous with the base fabric of the article of clothing ("grown on") rather than a being separate piece of fabric. As used herein, the base fabric refers to the fabric from which remaining portions of the article of clothing is made. For example, in some embodiments, a portion along an edge of a clothing pattern cut from the base fabric may be used to form the outer fabric layer of the waistband. The base fabric and the outer fabric layer may be made from natural and/or synthetic fibers, for example, a cotton, wool, flax, polyester, etc. or blends thereof, and may have any suitable textile weave used in the art (e.g., twill weave, plain weave, satin weave). In some embodiments, the base fabric and the outer fabric layer are made entirely or primarily of natural fibers (e.g., cotton, wool, flax, etc.) rather than synthetic fibers.

In certain embodiments, as will be explained further herein, one or more folds or pleats may be formed between the portion of the base fabric that forms the outer fabric layer of the waistband and the remainder of the base fabric. The one or more folds or pleats may be set in place by a stitch line according to some embodiments. In some embodiments, including the one or more folds or pleats provides a visual separation between the waistband and the remainder of the base fabric and, in some embodiments, may provide the appearance of a typical sewn-on waistband.

As discussed herein, in some embodiments an elastic layer is provided on an interior portion of the waistband. The elastic layer may be, for example, a layer of stretch tape or ribbon. The elastic layer, in some embodiments, may be made from a natural or synthetic elastic material such as, for example, polyester, nylon, polyurethane, silicone, rubber, latex, etc., or blends thereof. In an example embodiment, the elastic layer includes a stretch grosgrain tape. In some embodiments, the elastic layer is attached to an inner side of the outer fabric layer. In some embodiments, the outer fabric layer covers only a first side of the elastic layer such that the second side of the elastic layer remains exposed and forms the inner facing portion of the finished waistband (the portion intended to face the wearer's body during use).

Referring now to the drawings in detail, wherein like reference numerals indicate like elements throughout, there are illustrated in FIGS. 1-6, waistbands and articles of clothing having waistbands in accordance with exemplary embodiments of the present invention. It should be appreciated that, for simplicity and clarity, the illustrations may depict only a portion of the total waistband and/or article of clothing. Furthermore, unless specified otherwise, the illustrations are not necessarily shown to scale.

FIG. 1 illustrates a portion of a clothing pattern 100 for producing an article of clothing (e.g., trousers, shorts, etc.) according to an exemplary embodiment of the present invention. Clothing pattern 100 may be cut from a base fabric and, in some embodiments, may include one or more separate base fabric panels 102*a*-102*d* that are attached (e.g., sewn, adhered, welded, etc.) together at seams 104*a*-104*c* to form clothing pattern 100. As mentioned, the base fabric may include, for example, fabrics made from natural or synthetic fibers and may have any suitable weave. Clothing pattern 100 may include a waistband portion 106 that will form the outer fabric layer of the waistband for the article of clothing. Waistband portion 106, in some embodiments, is integral with base fabric panels 102*a*-102*d*. In some embodiments, waistband portion 106 extends along an edge (e.g., a top edge) of clothing pattern 100. In some embodiments, waistband portion 106 extends generally perpendicular to seams 104*a*-104*c* and may have, for example, a width of about 3 cm to about 5 cm.

As will be discussed further herein, in some embodiments, one or more folds 108 may be made in clothing pattern 100 to form a border between waistband portion 106 and the remaining portions of base fabric panels 102*a*-102*d*. Furthermore, according to some embodiments, clothing pattern 100 may include one or more (e.g., 1, 2, 3, 4, 5, or more) dart cuts 110, the edges of which can be stitched to form dart in the finished waistband of the article of clothing. In some embodiments, dart cuts 110 are wedge-shaped cuts which may extend at least through the width of waistband portion 106. In some embodiments, dart cuts 110 extend through the entire width of waistband portion 106 and at least partially into the remaining portions of the base fabric panels 102*a*-102*d*, as illustrated. In some embodiments, the top ends of the dart cuts 110 above the one or more folds 108 (e.g., the portion of dart cuts 110 in waistband portion 106) may be offset or angled with respect to the bottom ends of the dart cuts 110 below the one or more folds 108 (e.g., the portion of dart cuts 110 which extend into the base fabric panels 102*a*-102*d*). The offset or angle in dart cut 110 is provided in some embodiment such that, in the finished article of clothing wherein the dart cut 110 has been stitched to form the finished dart, the portion of the dart in waistband portion 106 is substantially aligned with the portion of the dart in the base fabric panel (e.g., the dart appears as a substantially continuous seam extending through the waistband portion 106 and into the base fabric panel). This may, for example, improve the visual appearance of the finished article of clothing. Otherwise, in some embodiments without the offset or angle, the one or more folds 108 may cause the portion of the dart in waistband portion 106 to appear misaligned with the portion of the dart extending into the base fabric panel. In some embodiments, the darts on the waistband portion 106 may be obscured, for example, by adding a belt loop over the darts.

Figure 2:
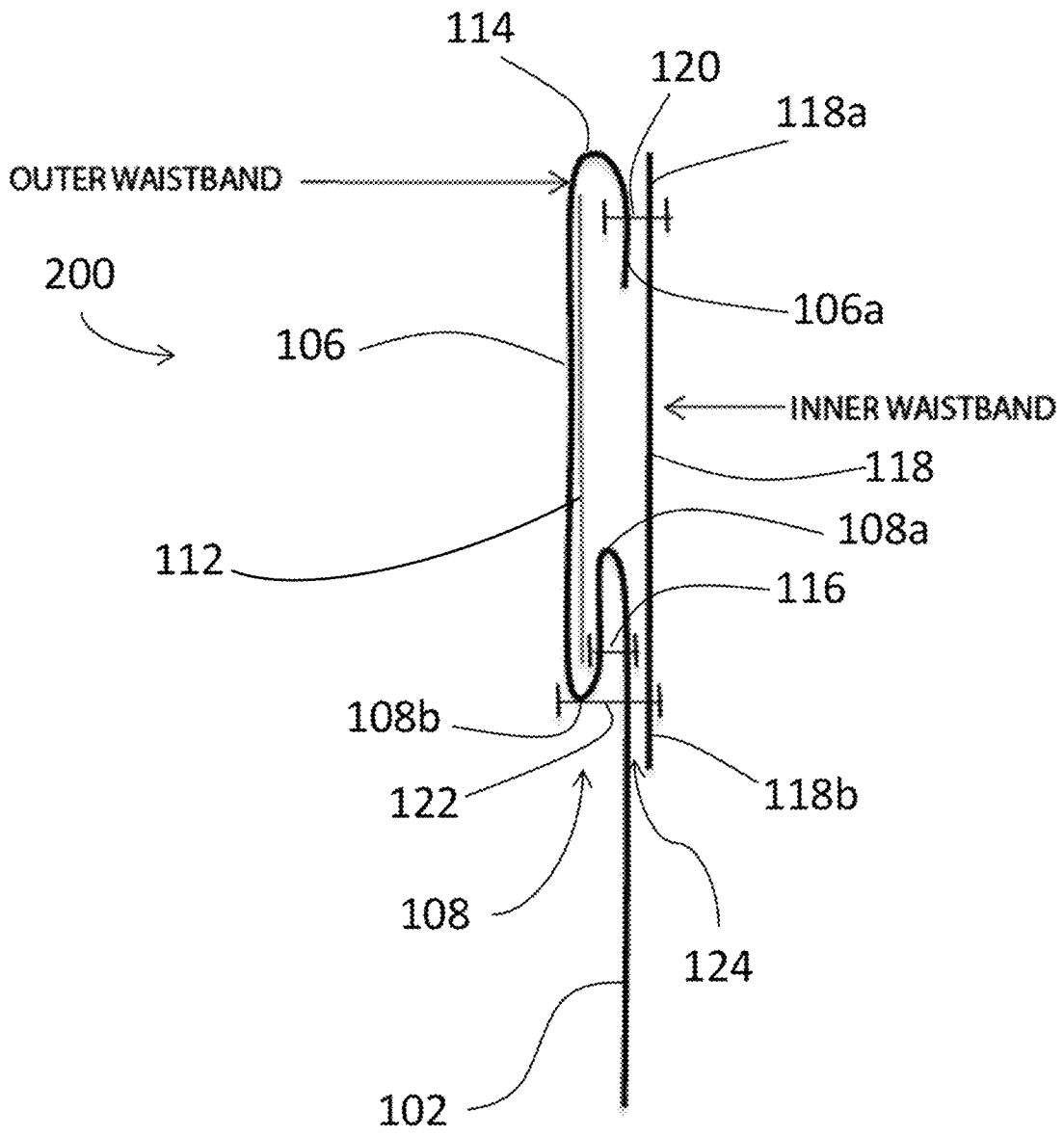
FIG. 2 shows a cross-sectional view of a waistband in accordance with an embodiment of the present invention.

FIG. 2 illustrates a cross-sectional view of a waistband 200 according to an embodiment of the present invention, which may be produced, for example, from clothing pattern 100 shown in FIG. 1. Relative to the page, the left side of the illustration represents an exterior side of waistband 200 which is intended to face away from the wearer and may be visible during use, and the right side of the illustration represents an interior side of waistband 200 which is intended to face the wearer and may be generally hidden from view during use. In some embodiments, waistband portion 106 of pattern 110 is configured to form an outer portion of waistband 200 (outer waistband), and an elastic layer 118 is configured to form an inner portion of waistband 200 (inner waistband). As discussed, elastic layer 118 may be, for example, a layer of stretch tape or ribbon which can be sized to extend along the length of waistband portion 106. Elastic layer 118, in some embodiments, may be made from a natural or synthetic elastic material such as, for example, polyester, nylon, polyurethane, silicone, rubber, latex, etc., or blends thereof. In an example embodiment, elastic layer 118 includes a stretch grosgrain tape. According to some embodiments, a further interlining layer 112 may be affixed to an inner side of waistband portion 106 between waistband portion 106 and elastic layer 118. In some such embodiments, interlining layer 112 may be included to provide additional structure and/or support to waistband 200. Interlining layer 112, in some embodiments, is or includes a stretch fusion layer that may be fused or otherwise adhered to the inner side of waistband portion 106.

As further illustrated in FIG. 2, in some embodiments the one or more folds 108 includes an initial bottom fold 108*a* and a final bottom fold 108*b* that together form a pleat as shown between waistband portion 106 and the remaining base fabric panel 102. In some embodiments, initial bottom fold 108*a* is positioned between elastic layer 118 and waistband portion 106. In some embodiments, initial bottom fold 108*a* is positioned between elastic layer 118 and interlining layer 112. The folds 108*a* and 108*b* may extend for the entire length of waistband 200 in some embodiments. In some embodiments, final bottom fold 108*b* forms a bottom edge of waistband 200 that may be visible from the exterior side of the waistband. In further embodiments, a top edge of waistband 200 may be formed by a top fold 114 wherein a top section 106*a* of waistband portion 106 is folded over towards the interior side. In some embodiments, a top edge of interlining layer 112 may be received within top fold 114 and a lower edge of interlining 112 may be received within the final bottom 108*b*.

In some embodiments, the overlapping fabric layers created by initial bottom fold 108*a* may optionally be sewn together by a first line of stitches 116 that may extend along the length of waistband 200. This may be accomplished, for example, before elastic layer 118 is attached to waistband portion 106. First line of stitches 116 may include, for example, single-needle stitches, lock stitches, chain stitches, etc. In some embodiments, first line of stitches 116 may be positioned between initial bottom fold 108*a* and final bottom 108*b* and will not be visible from the exterior side of waistband 200.

In some embodiments, a second line of stitches 120 may be used to secure elastic layer 118 to waistband portion 106. In some embodiments, a top section 118*a* of elastic layer 118 is attached to the top section 106*a* of waistband portion 106 by second line of stitches 120. Second line of stitches 120 may include, for example, single-needle stitches, lock stitches, chain stitches, etc. In some embodiments, second line of stitches 120 is positioned below top fold 114 and will not be visible from the exterior side of waistband 200.

In some embodiments, a third line of stitches 122 may be used to secure elastic layer 118 to waistband portion 106. In some embodiments, a bottom section 118*b* of elastic layer 118 is attached to waistband portion 106 by third line of stitches 122. In some embodiments, third line of stitches 122 secures bottom section 118*b* of elastic layer 118 to base fabric panel 102. Third line of stitches 122 may include, for example, single-needle stitches, lock stitches, chain stitches, etc. In some embodiments, third line of stitches 122 is positioned at or below final bottom 108*b* and may be visible from the exterior side of waistband 200. In certain embodiments, a portion of bottom section 118*b* may extend below third line of stitches 122 that forms a waistband curtain on the interior side of waistband 200. In some such embodiments, a space 124 may be present between at least a portion of bottom section 118*b* of elastic layer 118 and base fabric panel 102 that may be used to receive additional elements of the article of clothing. For example, in some embodiments, pocket bags may be positioned into space 124, as shown in FIG. 3, to provide a clean finish for the pocket bags.

Figure 3:
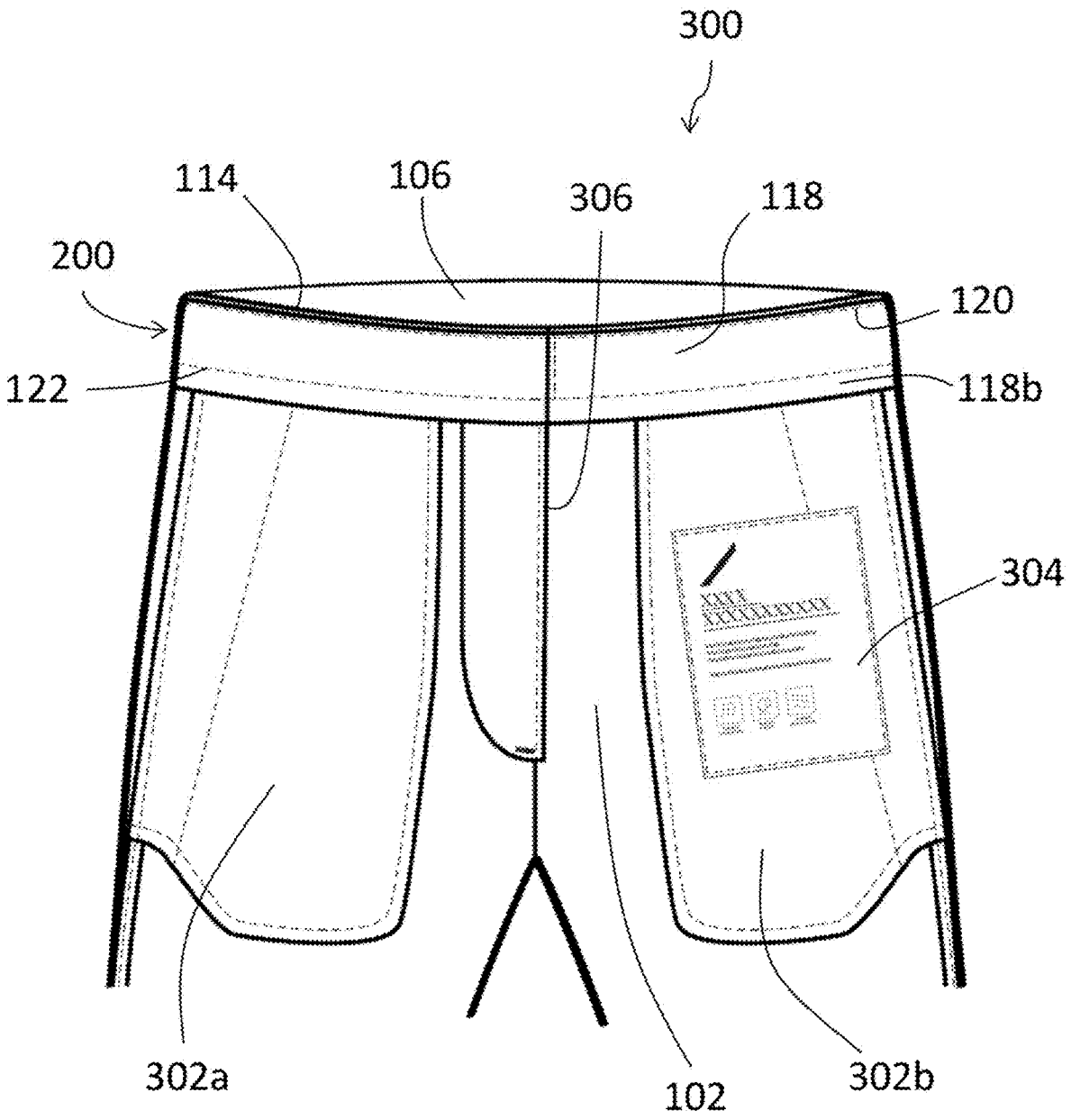
FIG. 3 shows an article of clothing with a waistband, turned inside out, in accordance with an embodiment of the present.

FIG. 3 shows a partial view of an example article of clothing (e.g., trousers 300) having waistband 200 according to an embodiment of the present invention and wherein base fabric panel 102 forms the legs of trousers 300. For ease of clarity, trousers 300 is shown inside out such that the interior of trousers 300 is turned to be on the outside. Trousers 300 may include, for example, at least two pocket bags 302*a*, 302*b* according to some embodiments. In some embodiments, at least one of the pocket bags 302*a*, 302*b* can include a label 304 which contains information, for example, washing/care instructions, brand logos, etc. In some embodiments, the at least two pocket bags 302*a*, 302*b* may be sewn onto base fabric panels 102. As discussed, in some embodiments, a top edge of pocket bags 302*a*, 302*b* may be sandwiched between bottom section 118*b* of elastic layer 118 and base fabric panel 102 below third line of stitches 122. In some embodiments, trousers 300 may further include a placket 306 that may extend through waistband 200. Placket 306 may include, for example, a zipper, buttons, or other fasteners.

Figure 4:
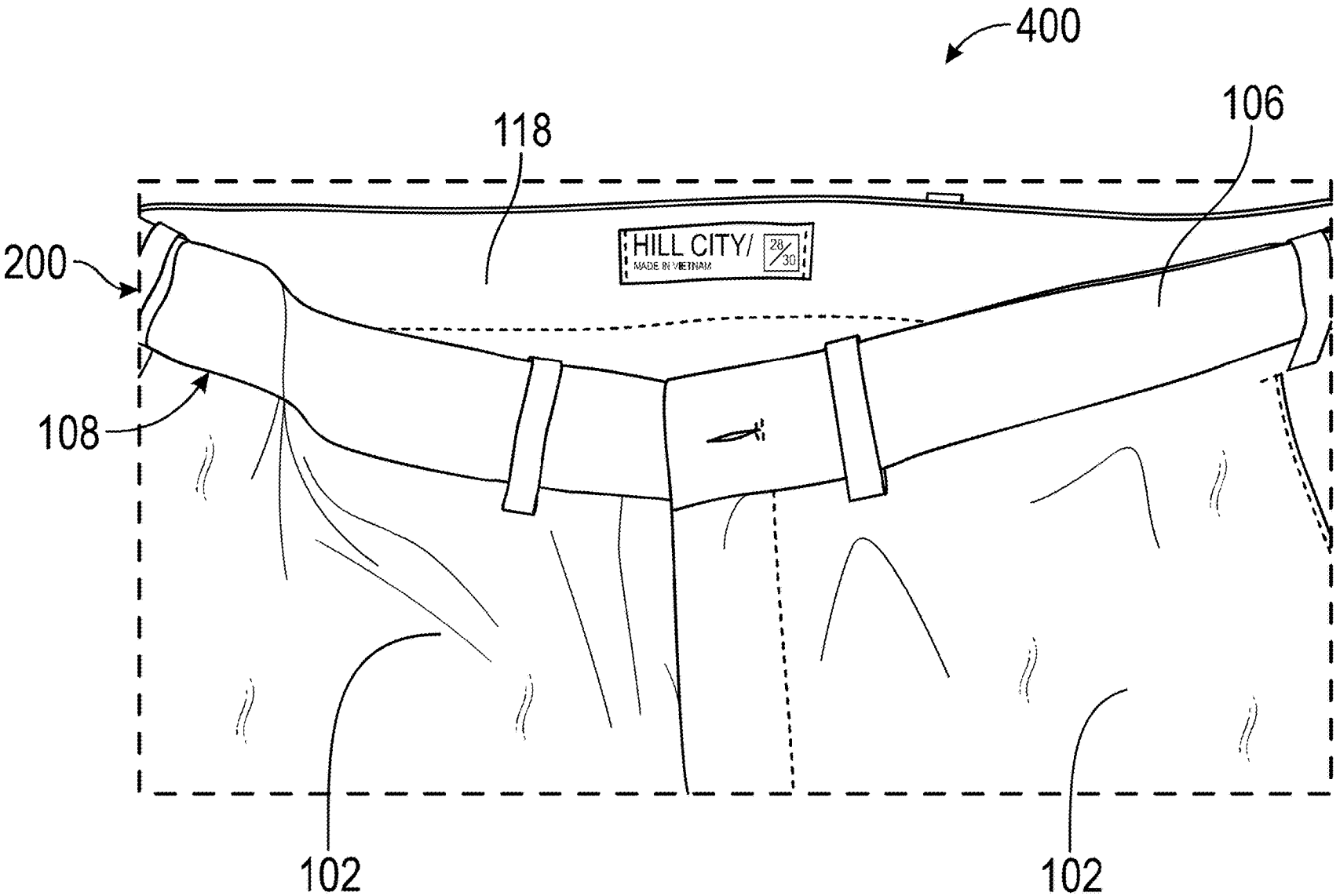
FIG. 4 is a photograph of a portion of an example article of clothing with a waistband in accordance with an embodiment of the present invention.
Figure 5:
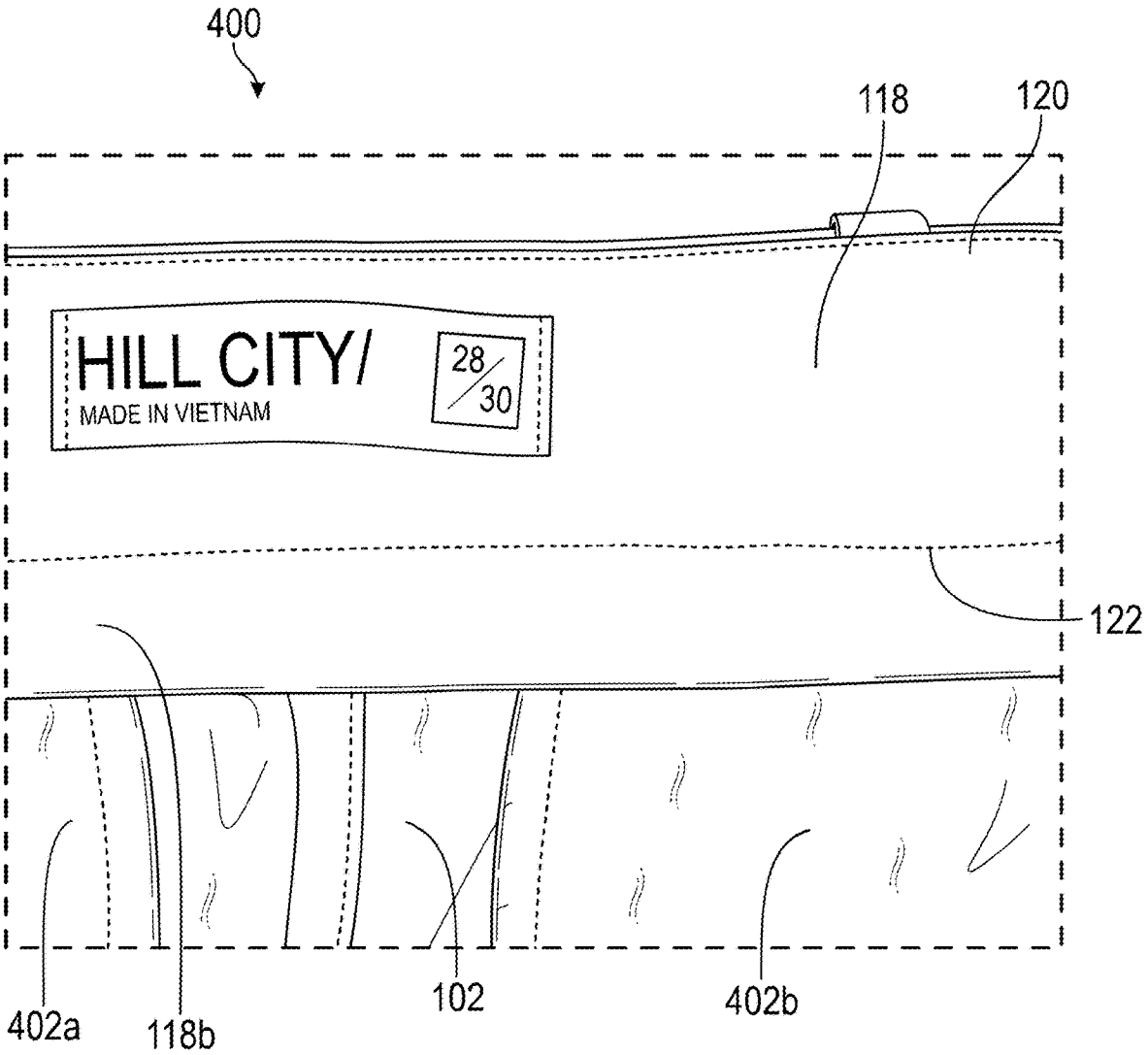
FIG. 5 is a photograph showing a detail of an interior portion of the waistband of the example article of clothing shown in FIG. 4.
Figure 6:
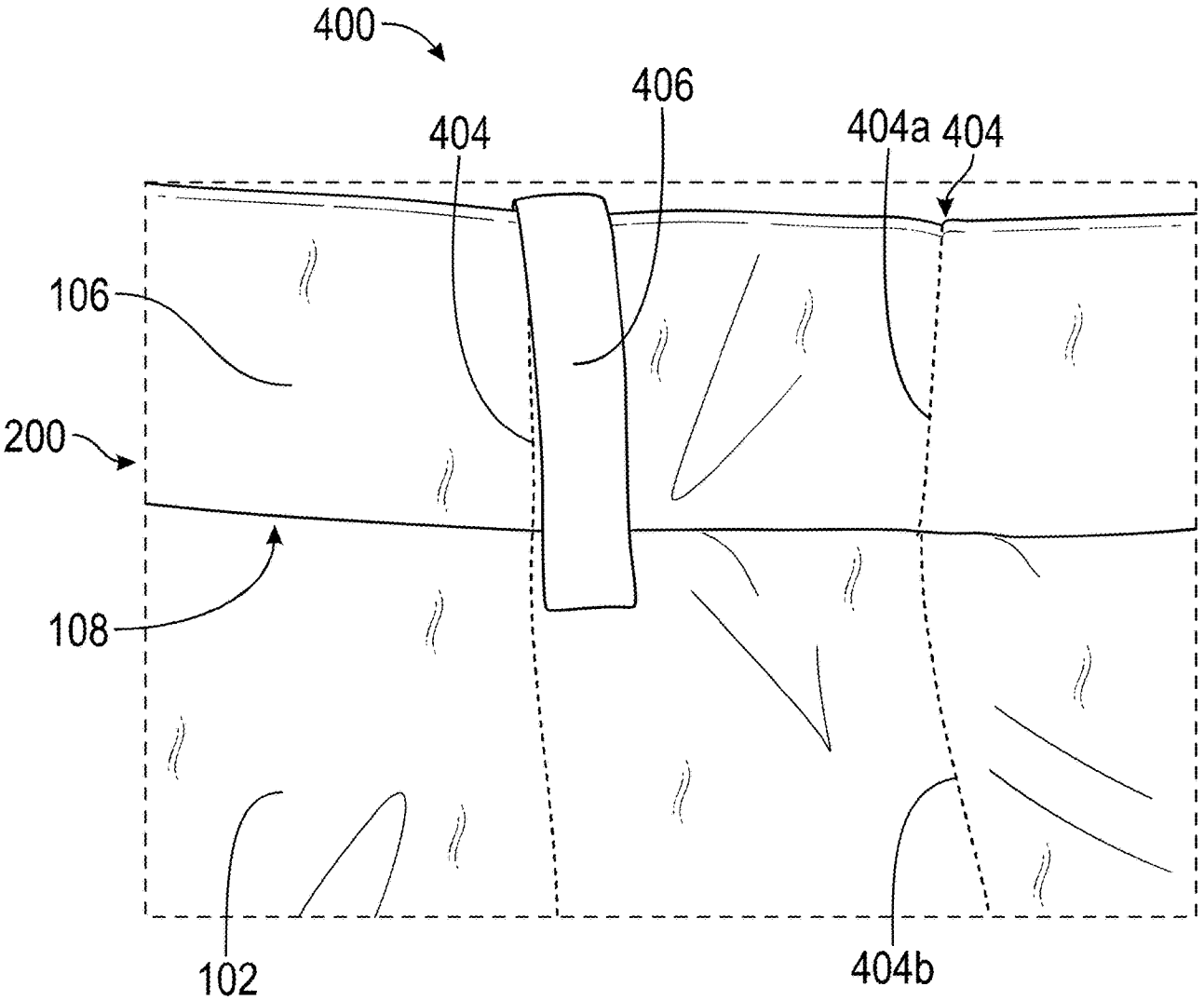
FIG. 6 is a photograph showing a detail of an exterior portion of the waistband of the example article of clothing shown in FIG. 4.

FIGS. 4-6 are photographs showing portions of an example article of clothing (e.g., trousers 400) constructed in accordance with an embodiment the present invention. Trousers 400 includes a waistband 200 having a waistband portion 106 forming an exterior side of waistband 200 which is contiguous with base fabric panels 102 that form remaining portions of trousers 400 (e.g., the trouser legs). In some embodiments, one or more folds 108 are made in the fabric to create a pleat between waistband portion 106 and base fabric panels 102. The pleat created by the one or more folds 108, for example, visually distinguishes waistband 200 from the base fabric panels 102 such that waistband 200 may have a traditional "sewn on" appearance.

Waistband 200 of trousers 400 further includes an elastic layer 118 which forms an interior side of waistband 200. Elastic layer 118 may be an elastic stretch tape, for example. Elastic layer 118 is attached to waistband portion 106 by lines of stitches 120, 122. As shown in FIG. 5, which provides an enlarged view of an interior portion of trousers 400, a bottom section 118*b* of elastic layer 118 may extend below line of stitches 122 such that a top portion of pocket bags 402*a*, 402*b* may be inserted between bottom section 118*b* and base fabric panels 102 to provide, for example, a cleaner finish.

FIG. 6 shows an enlarged view of an exterior portion of trousers 400. As shown in this embodiment, trousers 400 may include one or more darts 404. Each of the darts 404 extends through waistband portion 106 and into base fabric panel 102. As explained with regards to FIG. 1, darts 404 may be formed, for example, from dart cutouts 110 in fabric pattern 100. In some embodiments, as shown in FIG. 6, an upper segment 404*a* of dart 404 on waistband portion 106 may be substantially aligned with a lower segment 404*b* of dart 404 on base fabric panel 102 such that upper segment 404*a* appears to be a continuous seam with lower segment 404*b* despite being interrupted by the one or more folds 108. As further shown, in some embodiments trousers 400 may include one or more belt loops 406 that are positioned on the exterior side of waistband 200 and extend across the width of waistband portion 106. In some such embodiments, a belt loop 406 may be positioned adjacent to or over dart 404 to at least partially conceal dart 404 on waistband portion 106. As further shown, waistband portion 106 in some embodiments may have a generally flat or even appearance rather than a scrunched or ribbed appearance of certain other stretchable waistbands. Thus, the waistbands according to embodiments of the present invention may be suitable for use in apparel intended, for example, for casual or office environments (e.g., work trousers, slacks, etc.). Moreover, while the waistbands shown in the illustrated embodiments have been discussed in relation to trousers and pants, it should be appreciated that waistbands according to embodiments of the present invention may be used in other articles of clothing, for example, skirts, shorts, shorts, etc.

It should also be understood that various changes, substitutions, and alterations can be made herein without departing from the spirit and scope of the invention as defined by the appended claims. It should also be apparent that individual elements identified herein as belonging to a particular embodiment may be included in other embodiments of the invention. Moreover, the scope of the present application is not intended to be limited to the particular embodiments of the process, machine, manufacture, and composition of matter, means, methods and steps described in the specification. As one of ordinary skill in the art will readily appreciate from the disclosure herein, processes, machines, manufacture, composition of matter, means, methods, or steps that perform substantially the same function or achieve substantially the same result as the corresponding embodiments described herein may be utilized according to the present invention.

What is claimed is:

1. An article of clothing comprising a fabric comprising a continuous surface extending from a waistband portion of the fabric to a base fabric panel of the fabric, wherein an interior of the waistband portion comprises (i) at least two folds forming a border between the base fabric panel of the fabric and an exterior waistband portion of the fabric, the at least two folds comprising an initial bottom fold and a final bottom fold of the fabric at a bottom edge of the waistband portion and (ii) a top fold at a top edge of the waistband portion, and an interior of the final bottom fold and the interior of the top fold are common to the interior of the waistband portion.

2. The article of clothing of claim 1, wherein the article of clothing further comprises an elastic layer, and wherein the elastic layer is secured to the waistband portion through the initial bottom fold and the top fold.

3. The article of clothing of claim 2, wherein the elastic layer is secured to the initial bottom fold by a first line of stitching.

4. The article of clothing of claim 3, wherein the elastic layer is secured to the top fold by a second line of stitching different from the first line of stitching.

5. The article of clothing of claim 4, wherein the second line of stitching is not visible from an exterior of the article of clothing.

6. The article of clothing of claim 2, wherein the elastic layer comprises a tape or a ribbon.

7. The article of clothing of claim 2, wherein the elastic layer forms an inner facing portion of the article of clothing configured to face the wearer.

8. The article of clothing of claim 2, wherein the article of clothing further comprises an interlining layer interposing between the interior of the waistband portion and the elastic layer.

9. The article of clothing of claim 8, wherein the interlining layer occupies the interior of the waistband portion between the waistband portion and the elastic layer.

10. The article of clothing of claim 1, wherein the initial bottom fold and the final bottom fold form a pleat.

11. The article of clothing of claim 1, wherein the initial bottom fold and the final bottom fold extend for an entire length of the article of clothing.

12. The article of clothing of claim 4, wherein the initial bottom fold and the final bottom fold are secured by a third line of stitching different from the first line of stitching and the second line of stitching.

13. The article of clothing of claim 12, wherein the third line of stitching does not secure the elastic layer.

14. The article of clothing of claim 13, wherein a bottom edge of the elastic layer extends beyond the third line of stitching.

15. The article of clothing of claim 1, wherein the article of clothing further comprises a placket extending though a portion of the waistband portion.

16. The article of clothing of claim 1, wherein the article of clothing further comprises one or more darts, each of the one or more darts extending through the waistband portion and at least a portion of the base fabric panel.

17. The article of clothing of claim 16, wherein the one or more darts extends through a width of the waistband portion.

18. The article of clothing of claim 16, wherein a first dart in the one or more darts comprises a top end portion and a bottom end portion offset from the top end.

19. The article of clothing of claim 1, wherein the article of clothing is selected from the group consisting of trousers, pants, shorts, and skirts.

* * * * *